US005358606A

United States Patent [19]

Makkonen

[11] Patent Number: 5,358,606

[45] Date of Patent: Oct. 25, 1994

[54] PROCEDURE AND APPARATUS FOR FAULT LOCATION IN THE FUNCTIONING OF MACHINE ELEMENTS OF A PAPER MACHINE

[76] Inventor: Timo Makkonen, Helsinginkatu 15 B 46, SF-00500 Helsinki, Finland

[21] Appl. No.: 689,664

[22] Filed: Apr. 23, 1991

Related U.S. Application Data

[63] Continuation of Ser. No. 434,510, Nov. 14, 1989, abandoned, which is a continuation of Ser. No. 223,663, Jul. 21, 1988, abandoned, which is a continuation of Ser. No. 57,710, Jun. 1, 1987, abandoned, which is a continuation of Ser. No. 721,315, Apr. 9, 1985, abandoned.

[51] Int. Cl.[5] ..... D21F 7/06

[52] U.S. Cl. ..... 162/49; 162/198; 162/253; 162/263; 162/DIG. 6; 162/DIG. 11

[58] Field of Search ..... 162/252, 253, DIG. 6, 162/DIG. 11, 198, 49, 263

[56] References Cited

U.S. PATENT DOCUMENTS

| | | | |
|---|---|---|---|
| 3,687,802 | 8/1972 | Rummel et al. | 162/253 |
| 3,852,578 | 12/1974 | Rice | 162/DIG. 11 |
| 4,114,528 | 9/1978 | Walker | 162/206 |
| 4,374,703 | 2/1983 | Lebeau et al. | 162/DIG. 11 |

OTHER PUBLICATIONS

Simola; "Paperikoneprosessin Stabiiliuden Mittaaminen" 22–70 XII.

Epton; "Pulsation and Vibration Studies at the Wet End of a Paper Machine", *Paper Tech & Ind*, Apr. 1977 p. 114.

Parker et al; "Practical Investigation of Grammage Variations"; *Pulp & Paper Canada*, vol. 78, No. 11, p. 53, Nov. 1977.

Mardon et al; "Pressure Fluctuations in Headbox Approach Piping"; *Pulp & Paper Canada*, vol. 75, No. 2 Feb. 1974, p. 83.

Makki; "Experiences with the Sensodec–10 Condition Monitoring System", Paper Control Systems '86; Stockholm, Sweden.

Herdman et al; "Process Diagnostics in the Papermaking Industry"; IFAC Instr. & Automation in the Paper, Plastics & Polymerisation Ind; 1983.

*Pulp & Paper*, "Goal: Computer from 1 Year of Order Result: DDC or Time"; Apr. 1970.

Makkonen, "Pulsation Measurement and Analysis in the Stock Supply System for Paper Machines"; *Paper* vol. 192 No. 4, 1979.

Mardon et al, "Basis Weight Variation on a High Speed Newsprint Machine–Some Causes and Effects"; *Appita*, vol. 28, No.2 Sep. 1974.

Herdman et al, "Process Diagnostics in the Papermaking Industry", IFAC Instr. & Automation in the Paper, Plastics & Polymerisation Ind; 1983.

Parker; "Investigation of Vibrations and Disturbances"; *Pulp & Paper Canada*, vol. 80, No. 7 Jul. 1979.

"Calendar Barring" from Calendering and Supercalendering , Lockwood Trade Journal Co., Inc. New York 1964.

*Primary Examiner*—Steve Alvo

*Attorney, Agent, or Firm*—Andrus, Sceales, Starke & Sawall

[57] ABSTRACT

A procedure and apparatus for locating faults in the machine elements of a paper machine and in their functioning, wherein variations in the paper characteristics are continuously observed, the periodicity of the variations is recorded and the periodicity of the variations in the paper characteristics is compared with the periodicity in the functioning of the paper machine's machine elements. The apparatus comprises observation members (1–11) for observing the variations occurring in the paper characteristics; synchronizing pick-ups (43–53) disposed on machine elements (13–22) of the paper machine for observing the periodicity of the functioning of said machine elements; a recording means (40) for recording the periodicity of the variations in paper characteristics and the periodicity in the functioning of the machine elements; and a data processing unit (41) for comparing the periodicity of the variations in paper characteristics and that in the functioning of the machine elements.

8 Claims, 2 Drawing Sheets

PROCEDURE AND APPARATUS FOR FAULT LOCATION IN THE FUNCTIONING OF MACHINE ELEMENTS OF A PAPER MACHINE

This application is a continuation of application Ser. No. 07/434,510 filed Nov. 14, 1989, now abandoned, which is a continuation of Ser. No. 07/223,663 filed Jul. 21, 1988, now abandoned, which is a continuation of Ser. No. 07/057,710 filed Jun. 1, 1987, now abandoned, which is a continuation of Ser. No. 06/721,315 filed Apr. 9, 1985, now abandoned.

The present invention concerns a procedure and apparatus for fault location in the operation of machine elements of a paper machine.

In a paper machine, a fibre web is formed on the wire section, onto which pulp stock is conducted from the headbox through a narrow lip sluice. A prerequisite for uniform web formation is that the pressure in the headbox is stable and that the composition of the pulp stock is homogeneous. The uniform composition and/or consistency quality of the pulp stock entering the headbox and the stability of the overall pressure prevailing in the headbox may be detrimentally affected by faults or faulty functioning of the headbox and of the machine elements preceding the headbox.

Dewatering of the web takes place mainly in the wire section, where, as above, the faults or faulty functioning of machine elements cause unevenness in the paper web.

After the wire section, the web is dewatered by wet pressing, in which the web is passed through a press zone, or nip. The nip is defined by two rolls which are urged against each other. The operation of the nip is affected by numerous ancillaries and structures, such as a press felt, elastic coating on one or both rolls, a recessed surface on one or both roll surfaces produced by perforation, grooving or in another way, a plastic or metal wire between the felt and the roll surface, etc. The press section has usually several different nips. The press section as a whole is a complex construction, and its trouble-free operation is of primary importance to the runability of the paper machine. In addition, faulty machine elements and/or faulty functioning in the press section may cause objectionable variation in the paper.

After the drying section, or in some cases also in the middle of the drying process, the paper may be subjected to a treatment called calendering. Its most important aim is to achieve desired surface smoothness and gloss of the paper and to adjust the thickness and density of the paper to be as desired. In the calendering process the web is conducted through one or several press zones, or nips, constituted by hard-surfaced and smooth rolls. Due to faults in the rolls, or to other faulty functioning of the calender, the desired properties or smoothness are not always achieved in the paper, and the calender may even cause objectionable variation in the paper.

The above-presented causative factors responsible for the variations in the paper caused by faults or faulty functioning of machine elements of the paper machine cannot be directly located with the aid of the analyzing equipment nowadays provided on paper machines. Problems in locating the functional faults of machine elements causing defects in the quality of the paper being turned out are particularly introduced by the great number and diverse functions of machine elements. In practice it is almost impossible to find out directly, without extensive studies and experimentation, which machine element's fault or faulty functioning is responsible in each instance for a given defect of a paper characteristic or for the change in quality.

The object of the present invention is to eliminate the drawbacks mentioned and to introduce an entirely novel procedure and apparatus for locating faults of machine elements in a paper machine and their faulty functioning. Furthermore, the object of the present invention is to create new conditions for trouble-free and rather more economical running of paper of a quality more uniform than before, with the aid of a totally novel method of measurement and analysis.

Regarding the characteristic features of the invention, reference is made to the claims.

The invention is based on continuous on-line observation of the paper characteristics and on continuous recording of the periodicity in the functioning of the paper machine's machine elements. As taught by the invention, the periodicity of the variations in the paper characteristics are matched with the periodicity of the paper machine's machine elements in order to locate the sources of variations in the paper characteristics and of faults.

Thanks to the invention, the drawbacks mentioned in the foregoing can be eliminated by locating the faults in the functioning of the paper machine's machine elements and repairing or correcting those machine elements which cause the faults. Furthermore, thanks to the invention, favourable conditions can be created for running without trouble, and more economically than before, paper which is more uniform in quality, with the aid of an entirely new kind of measuring and analyzing procedure. In addition, it is possible, thanks to the invention, to locate latent faults in the paper machine's machine elements even before said machine elements prevent the running of the paper machine, as said latent faults will cause an obligatory stop later on. Therefore, thanks to the invention, the repair measures can be planned in advance and concentrated so that the economic losses caused by shut-downs for repair are minimized and paper quality and economy of production are guaranteed in the long run.

The invention is described in the following in detail with the aid of embodiment examples, reference being made to the drawing attached, wherein:

DETAILED DESCRIPTION OF THE INVENTION

Figure 1:
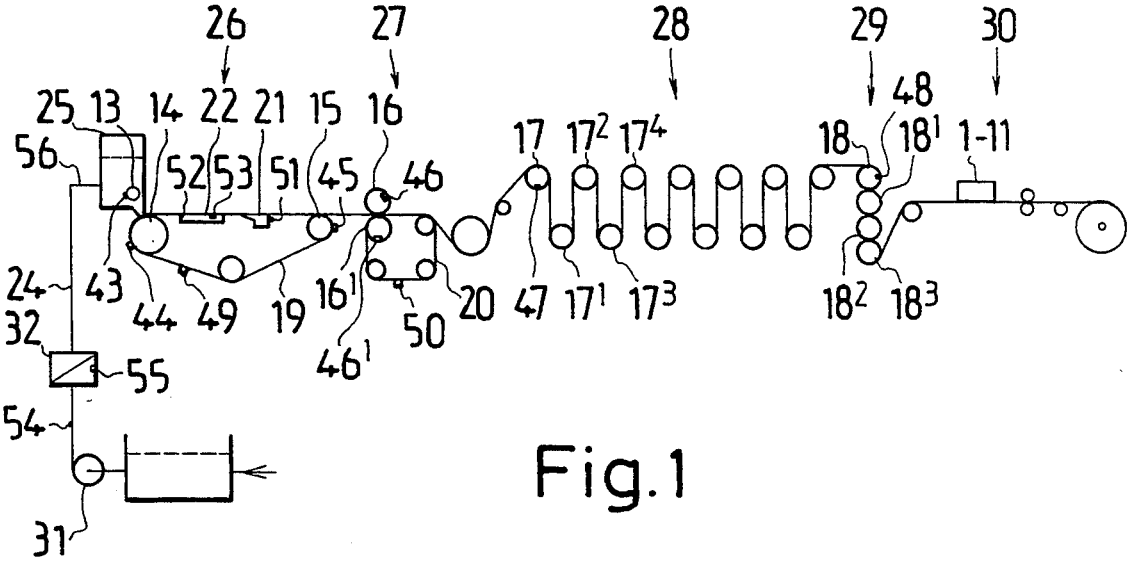
FIG. 1 presents a paper machine provided with the apparatus of the invention.
Figure 2:
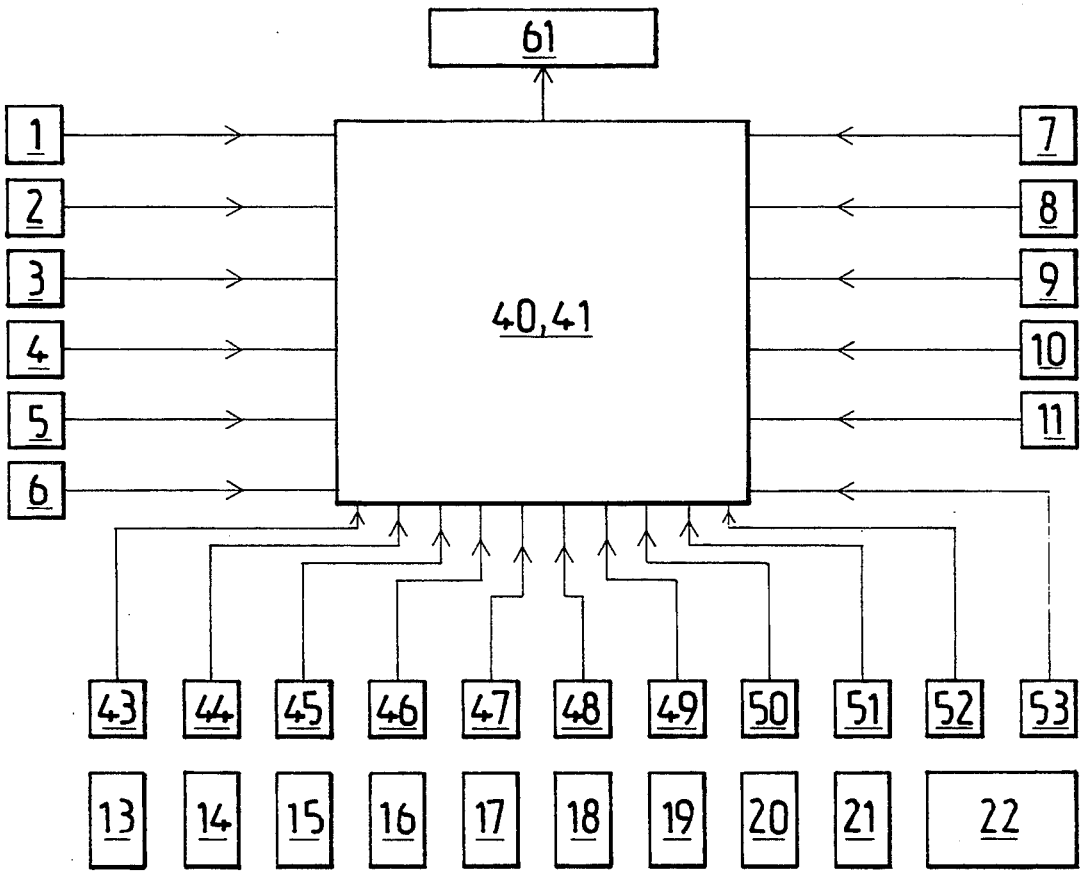
FIG. 2 presents the procedure and apparatus of the invention in the form a flow diagram, FIG. 3 displays, as recorded with a procedure according to the invention, the variations in a certain paper characteristic and the periodicity of certain machine elements of the paper machine.

In FIG. 1 is shown a paper machine presented by a schematic diagram, which has been provided with the means of the invention. In this embodiment, the paper machine comprises, for instance, a headbox 25, a wire section 26, a press section 27, a drying section 28, a calender 29 and a paper reeling apparatus 30. Furthermore, the apparatus comprises the headbox approach pipe system 24 with pumps 31 and strainers 32. The paper machine of FIG. 1 has been fitted with observation members 1–11, that is, paper analyzing equipment for observing the characteristics of the paper being manufactured and the variations occurring in these characteristics. Furthermore, the apparatus comprises respective synchronizing pick-ups 43–53 mounted on different machine elements and components 13–22 of the paper machine for observing continuously the periodicity of said machine elements and components. In FIG. 1 is not depicted the recording means belonging to the apparatus of the invention for recording the periodicity of the paper characteristics variations that have been observed and the periodicity in the functioning of the machine elements, nor the data processing unit for matching the periodicity of said recorded paper characteristics variations and that of the machine elements' functioning; instead, the recording means 40 and data processing unit 41 are seen in FIG. 2, which corresponds to the functional block diagram of the apparatus of the invention provided in conjunction with the paper machine presented in FIG. 1, and which is described more in detail later on.

The observation members 1–11 presented in FIG. 1 are meant to monitor in continuous operation the desired characteristics of the paper that is being manufactured, for instance its basis weight, thickness, smoothness, transmission, fibre orientation, permeability to air, water content, gloss, opacity, filler content, and e.g. the fluttering of the web. The observation members 1–11 consist suitably of conventional on-line analysis apparatus which is commonly available. If desired, the apparatus may also comprise observation members monitoring other paper characteristics, or merely one or some of the observation members monitoring the characteristics listed above.

In the embodiment presented in FIG. 1, synchronizing pick-ups placed in conjunction with some machine elements of the paper machine for observing and recording the periodicity of those machine chine elements have been shown by way of example. Thus, the perforated roll 13 in the headbox 25, the breast roll 14 and suction cylinder 15 of the wire section 26, the suction box 22, the wire 19, the felt 20, and the doctor blade 21 are provided with synchronizing pick-ups 43; 44; 45; 52; 49; respectively 50; and 51; The suction box 22 of the wire section is also provided with a pressure pick-up 53 for observing the pressure variations occurring periodically. Furthermore, on the rolls 16,16' of the press section 27 are mounted synchronizing members 46', respectively 46'. Furthermore, on the rolls $17^1$–$17^4$ of the drying section 28 are mounted synchronizing pick-ups 47; in the figure has only been depicted the pick-up mounted in conjuntion with the roll 17, for illustrating the construction. Furthermore, the rolls $18^1$–$18^3$ of the calender 29 following after the drying section are provided with synchronizing pick-ups 47; in the figure has only been depicted the pick-up mounted on the roll 18, for illustrating the construction.

In FIG. 1, on the headbox approach pipe system 24 of the paper machine have also been mounted pressure pick-ups 54, 55 and 56 in the part of the pipe system between the feed pump 31 and the strainers 32, for observing the periodicity of the pressures and pressure variation in the pipe system part between the pressure side of the strainers and the strainers and headbox, respectively.

The synchronizing pick-ups and pressure pick-up 43–53 shown in FIG. 1 are only intended to illustrate the invention, and such synchronizing pick-ups may be mounted at a far greater number of locations in the paper machine. It should be noted that, for greater perspicuity, the present embodiment depicted concerns a simplified and stripped paper machine design, while in reality there may be e.g. hundreds of different locations in the paper machine, such as rolls, suction boxes, suction cylinders, doctor blades, etc., where synchronizing pick-ups may be disposed.

The synchronizing pick-ups consist, in the case of roll doctors and suction boxes, advantageously of vibration pick-ups. In the case of rolls, or e.g. of a wire or felt, the synchronizing pick-up consists suitably of a pick-up measuring revolutions per unit time or speed of rotation.

In FIG. 2 is seen the functional block diagram of the procedure and apparatus of the invention. The observation members or pick-ups 1–11 measuring characteristics of the paper, such as the paper's basis weight, thickness, smoothness, transmission, fibre orientation, air permeability, moisture content, gloss, opacity, filler content and e.g. web flutter, transmit to a recording means 40 and to a data processing unit 41, or computer, the measured signals describing the paper characteristics. Furthermore, in the recording means 40 are recorded the signals transmitted by the synchronizing pick-ups 43–53 observing the periodicity of the functioning of the machine elements and components 13–24 of the paper machine. The computer 40,41 records the signals which it receives and compares the periodicity of the variations occurring in the paper characteristics with the periodicity in the functioning of various machine elements of the paper machine. When the same periods and/or period multiples recur in any one characteristic of the paper and in the functioning of a machine element of the paper machine, the computer has been programmed to report this paper characteristic variation and the respective machine element having a function period consistent with said variation period of the paper characteristic. It is then possible to subject the respective machine element, e.g. a given roll, to closer examination for observing the faults in its functioning at the earliest possible stage. Hereby, the repairs on the machine element may be timed in planned manner to be carried out at the most favourable time possible, in view of the overall economy of the paper machine. In this way, the present invention affords entirely new possiblities to monitor the functioning of different components of the paper machine, in particular with a view to servicing and maintenance.

Figure 3:
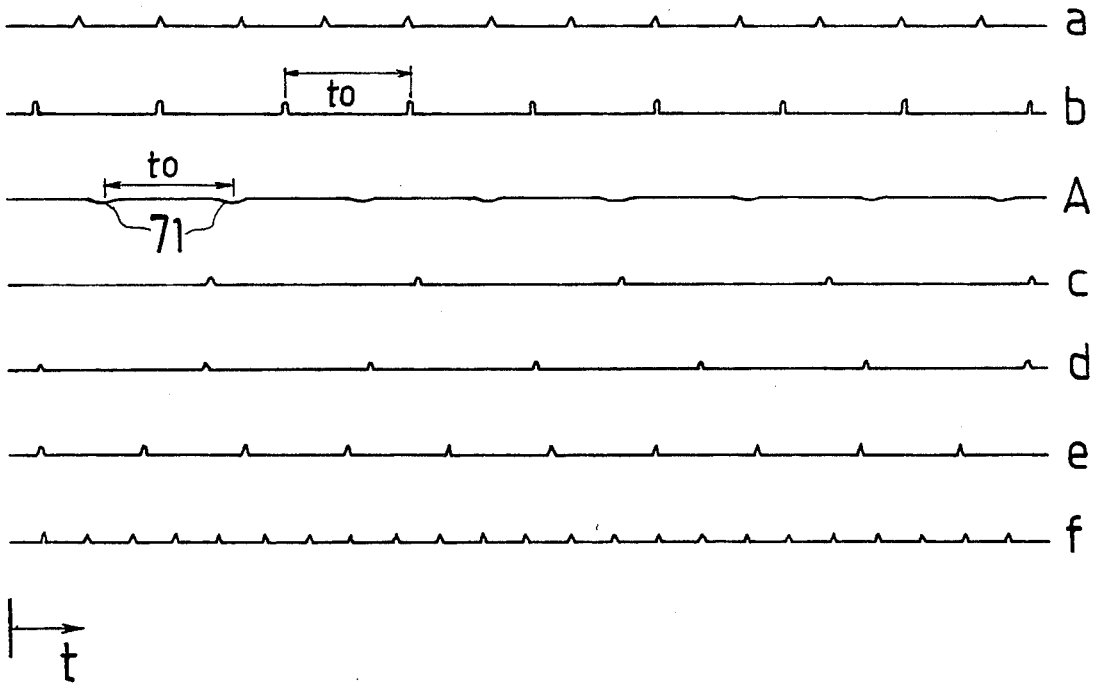

In FIG. 3 are illustrated the periodicity of some paper machine components and the variations in the paper quality, plotted over time t. In the figure, the graphs a, b, c, d and e represent the periodicity of some paper machine rolls, observed e.g. as shown in FIGS. 1–2. The graph f, for instance, represents the pressure variations in the headbox. The graph A represents variations occurring in the paper characteristics, e.g. in the paper thickness. The paper thickness appears to be comparatively uniform and it complies with the quality requirements. However, deviations are observed in the paper thickness at time intervals $t_o$. Comparison of the time interval $t_o$ with the periodicity of the graphs a–f of the machine elements reveals that the same periods $t_o$ occur in the graph b of a machine element, e.g. of the suction roll 15. The suction roll may then be subjected to closer examination for determining the condition of the roll.

It should be noted that in the present description, the term 'paper machine' is understood to mean a conventional paper machine, a cardboard machine, or a machine used for producing cellulose. Furthermore, the term 'paper machine' is understood to mean apparatus which are associated with said types of machine, or separate machines used in paper making, such as a drying section, wire section, paper coating machine, supercalender, etc.

The embodiment examples are intended merely to illustrate the invention, and the inventive idea may within the scope of the claims be applied in any kind of paper machine and apparatus associated with such.

We claim:

1. A process for determining which paper machine element of a plurality of paper machine elements is faulty and causing a periodically-recurring variation in one or more characteristics of the paper produced by the paper machine, the paper machine elements each exhibiting a period during its operation, said process comprising the steps of:

continuously monitoring at least one paper characteristic and thereby variations in said paper characteristic;

recording the periods of recurrence of variations in the monitored paper characteristic;

continuously monitoring the operation of each of the plurality of machine elements of the paper machine, so as to monitor the period of recurring variation of each machine element during its operation;

recording the period of recurring variation of each of the plurality of machine elements of the paper machine during operation of the machine element;

comparing the recorded periods of recurrence of the variations occurring in the monitored paper characteristic with the recorded periods of recurring variation of each of the plurality of machine elements during operation; and ascertaining, from the comparison, the existence of a temporal similarity between the period of recurrence of the paper characteristic variation and the periods of recurring variation of one of the plurality of machine elements during operation for determining which one of the plurality of the machine elements in the paper machine is causing the periodic variation in the characteristic of the paper being produced by the paper machine.

2. Process according to claim 1, wherein at least one of the following paper characteristics is monitored and the periods of recurrence of variations occurring therein continuously recorded and compared to the periods of recurring variation of the plurality of machine elements of the paper machine during operation: basis weight, thickness, smoothness, transmission, fibre orientation, air permeability, moisture content, gloss, opacity, filler content, and web flutter.

3. Process according to claim 2, wherein at least one of the following functions of the plurality of machine elements of the paper machine is monitored and the period of recurring variation of the machine element in its functioning recorded: vibrations of the perforated roll in the headbox, of the breast roll of the wire section, of the suction cylinder in the wire section, of a roll in the press section, of a roll in the drying section, of a calender roll, of a doctor blade, or of the suction box; rotation of the wire or of the felt; and pressure variations in the suction box of the wire section or in the hadbox approach pipe system.

4. Process according to claim 1, wherein at least one of the following elements of the paper machine is continuously monitored and the period of recurring variation of the machine element during operation recorded and compared to the periods of recurrence of variations in the monitored paper characteristic: vibrations of the perforated roll in the headbox, of the breast roll of the wire section, of the suction cylinder in the wire section, of a roll in the press section, of a roll in the drying section, of a calender roll, of a doctor blade, and of the suction box; rotation of the wire or of the felt; and pressure variations in the suction box of the wire section or in the headbox approach pipe system.

5. An apparatus for determining which paper machine element of a plurality of paper machine elements is faulty and causing a periodically-recurring variation in at least one characteristic of the paper produced by the paper machine, the paper machine elements each exhibiting a period during its operation, said apparatus comprising: observation members (1–11) for continuously observing variations occurring in at least one characteristic of the paper being produced; a synchronizing pick-up (43–53) disposed on each of the plurality of machine elements (13–22) of the paper machine for continuously observing the period of recurring variation each of the machine elements during operation; a recording means (40) for continuously recording the period of recurrence of variations in the observed paper characteristic and the periods of recurring variation of each of the plurality of machine elements during operation; and a data processing unit (41) for comparing the periods of recurrence of the recorded variations in the paper characteristic with the periods of recurring variation each of the plurality of machine elements during operation and for ascertaining, from the comparison, the existence of a temporal similarity between the period of recurrence of the paper characteristic variation and the periods of recurring variation of one of the plurality of machine elements during operation for determining which one of the plurality of the machine elements in the paper machine is causing the periodically-recurring variation in the monitored characteristic of the paper being produced by the paper machine.

6. Apparatus according to claim 5, wherein the observation members (1–11) for continuously observing the variations occurring in the paper characteristic comprise means for monitoring at least one of the following paper characteristics: basis weight, thickness, smoothness, transmission, fibre orientation, air permeability, moisture content, gloss, opacity, filler content of the paper, and flutter of the web.

7. Apparatus according to claim 6, wherein at least one of the synchronizing pick-ups (43–53) for continuously observing the periods of recurring variation of each of the plurality of machine elements of the paper machine during operation is disposed in at least one of the following locations: perforated roll (13) in the headbox (25), breast roll (14) of the wire section (26), suction cylinder (15) of the wire section (26), roll (16) in the press section (27), roll (17) in the drying section (28), roll (18) in the calender (29), wire (19), felt (20), doctor blade (21), suction box (22), and headbox approach pipe system (24).

8. Apparatus according to claim 5, wherein at least one of the synchronizing pick-ups (43–53) for continuously observing the periods of recurring variation of each of the plurality of machine elements of the paper machine during operation is disposed in at least one of the following locations: perforated roll (13) in the headbox (25), breast roll (14) of the wire section (26), suction cylinder (15) of the wire section (26), roll (16) in the press section (27), roll (17) in the drying section (28), roll (18) in the calender (29), wire (19), felt (20), doctor blade (21), suction box (22), and headbox approach pipe system (24).

* * * * *